US011686308B2

(12) United States Patent
Varadaraj et al.

(10) Patent No.: US 11,686,308 B2
(45) Date of Patent: Jun. 27, 2023

(54) OIL-FREE WATER-INJECTED SCREW AIR COMPRESSOR

(71) Applicant: ELGI EQUIPMENTS LTD, Coimbatore (IN)

(72) Inventors: Jairam Varadaraj, Coimbatore (IN); Venu Madhav Kuppachi, Coimbatore (IN); Shinu Kizakkumpat, Ernakulam (IN); Sundaranathan Ramanathan, Coimbatore (IN); Jerrin Paul, Ernakulam (IN)

(73) Assignee: ELGI EQUIPMENTS LTD, Coimbatore (IN)

( * ) Notice: Subject to any disclaimer, the term of this patent is extended or adjusted under 35 U.S.C. 154(b) by 0 days.

(21) Appl. No.: 17/292,675

(22) PCT Filed: Nov. 8, 2019

(86) PCT No.: PCT/IN2019/050830

§ 371 (c)(1),
(2) Date: May 10, 2021

(87) PCT Pub. No.: WO2020/095328

PCT Pub. Date: May 14, 2020

(65) Prior Publication Data

US 2022/0003234 A1 Jan. 6, 2022

(30) Foreign Application Priority Data

Nov. 8, 2018 (IN) ..... 201841042172

(51) Int. Cl.
*F03C 2/00* (2006.01)
*F03C 4/00* (2006.01)
(Continued)

(52) U.S. Cl.
CPC ..... *F04C 18/16* (2013.01); *F04C 27/009* (2013.01); *F04C 29/02* (2013.01); *F04C 29/042* (2013.01);
(Continued)

(58) Field of Classification Search
CPC .. F04C 18/16; F04C 27/0009; F04C 29/0007; F04C 29/02; F04C 29/04; F04C 29/042;
(Continued)

(56) References Cited

U.S. PATENT DOCUMENTS 3,975,123 A 8/1976 Schibbye
7,413,419 B2 8/2008 De Smedt et al.
(Continued)

FOREIGN PATENT DOCUMENTS

JP 5425049 B2 2/2014

OTHER PUBLICATIONS

International Search Report and Written Opinion in PCT International Application No. PCT/IN2019/050830 dated May 14, 2020, 11 pages.

*Primary Examiner* — Theresa Trieu
(74) *Attorney, Agent, or Firm* — Greenberg Traurig, LLP

(57) ABSTRACT

An oil-free water-injected screw air compressor comprises a housing that encloses two rotors for generating compressed air, and an air water separator for separating the water from the compressed air. Water injection can effectively cool a compressor, and some embodiments provide a sealing system for isolation of compressor bearing lubricant from water used for cooling.

16 Claims, 9 Drawing Sheets

(51) Int. Cl.

| | |
|---|---|
| ***F04C 2/00*** | (2006.01) |
| ***F04C 18/00*** | (2006.01) |
| ***F04C 18/16*** | (2006.01) |
| ***F04C 27/00*** | (2006.01) |
| ***F04C 29/02*** | (2006.01) |
| ***F04C 29/04*** | (2006.01) |

(52) U.S. Cl.
CPC .... *F04C 2240/52* (2013.01); *F04C 2240/809* (2013.01)

(58) Field of Classification Search
CPC ..... F04C 29/045; F04C 2240/52; F04C 2240/809; F04C 2270/0421; F04C 2270/20; F04C 2270/205
See application file for complete search history.

(56) References Cited

U.S. PATENT DOCUMENTS

| | | | | |
|---|---|---|---|---|
| 2004/0219045 | A1 | 11/2004 | Yoshimura et al. | |
| 2005/0147517 | A1* | 7/2005 | Dreifert | F04C 29/0007 418/85 |
| 2011/0135528 | A1* | 6/2011 | Amano | F04C 18/16 418/201.1 |
| 2012/0230857 | A1* | 9/2012 | Noguchi | F04C 18/16 418/201.1 |

* cited by examiner

OIL-FREE WATER-INJECTED SCREW AIR COMPRESSOR

CROSS REFERENCE TO RELATED APPLICATIONS

This application is a U.S. National Phase patent application of PCT International Application No. PCT/IN2019/050830, filed Nov. 8, 2019, which claims priority to and the benefit of Indian Application No. 201841042172, filed on Nov. 8, 2018, the entire contents of each of which are hereby incorporated by reference in their entireties.

TECHNICAL FIELD

The present subject matter relates to a screw air compressor which uses water as cooling and sealing agent instead of oil and thus produces oil-free compressed air.

BACKGROUND

Screw compressors can be used for compressing air through rotary action of a pair of screws. The chamber in which the screws are housed is also referred to as a working space. It is well known that injecting water into the working space, onto the screws, can improve the efficiency, lower the discharge temperature, and thus enables oil-free compression of air to pressure as high as 5 to 12 bar(g) in a single stage. However, injection of the water may complicate the lubrication of bearings. Mixing of the lubricant with water may lead to emulsification of the lubricant, deteriorate its lubricating properties, and affect the reliability of the compressor.

By using mechanical seals, the bearings and the lubricant can be protected from water entry. However, mechanical seals consume a significant amount of space and increase power loss.

U.S. Pat. No. 7,413,419 describes a water injected screw compressor which use water lubricated slide bearings eliminating the need for oil for lubrication. Such a system depends on pressurized water to support the load. Water being a poor lubricant can reduce reliability of such a system.

U.S. Pat. No. 3,975,123 describes a sealing system for a water injected screw compressor using a combination of labyrinth seals and buffer air for sealing the lubricant and bearing chamber. This system involves several valves for regulating and directing the flow making it less reliable.

U.S. Pat. No. 0,230,857 describes a sealing system for a water injected screw compressor using a combination of two non-contact seals and lip seal with additional arrangement for reducing load on the lip seal. This system is suitable for low pressure applications. When the compressor is operated at pressures in excess of 10 bar(g) the number of seals used in this system is insufficient. This efficiency of this system is also low as the region before the first non-contact seal is connected to a low pressure point in the compressor. This will increase the compressed air quantity which will leak into the low pressure point on the suction side.

BRIEF DESCRIPTION OF DRAWINGS

The features, aspects, and advantages of the subject matter will be better understood with regard to the following description and accompanying figures. The use of the same reference number in different figures indicates similar or identical features and components.

FIG. 6 shows a rotating radial member provided on a rotor shaft of a screw compression device, in accordance with an example implementation of the present subject matter.

DETAILED DESCRIPTION

The present subject matter relates to providing sealing, lubrication, and cooling for an oil-free water-injected screw compressor. The present subject matter provides economical and reliable techniques for sealing, lubrication, and cooling for a screw compression device.

Figure 1:
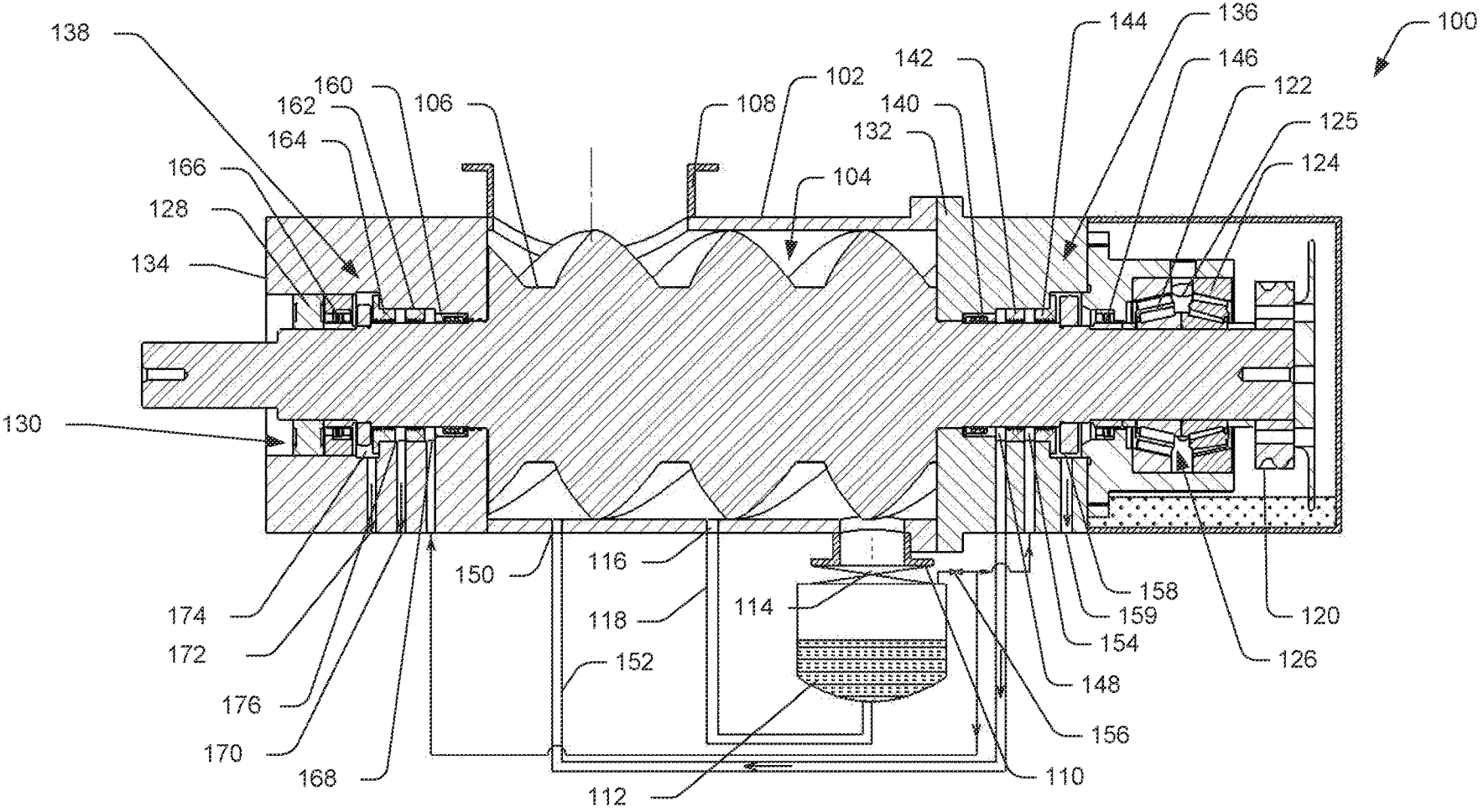
FIG. 1 illustrates a longitudinal section of a screw compression device with details of a sealing system, in accordance with an example implementation of the present subject matter.

FIG. 1 illustrates a longitudinal section of a screw compression device 100 with details of a sealing system, in accordance with an example implementation of the present subject matter. The screw compression device 100 may be interchangeably referred to as the compressor 100. The compressor 100 comprises a housing 102 that defines a working space 104, in which air is compressed.

The working space 104 encloses a male screw rotor 106 and a female screw rotor (not shown in FIG. 1), interchangeably referred to as the male rotor 106 and the female rotor. The rotors may be metallic rotors and may be made of stainless-steel material. The rotors may be provided with a special coating to protect the rotor surfaces from corrosion and erosion due to contact with water during operation. The special coating also prevents any damage to rotor surfaces when exposed to stagnant water in the working space 104 when the compressor 100 is not in operation. The special coating may be, for example, electroless Nickel or Polytetrafluoroethylene (PTFE).

During operation of the compressor 100, air may be supplied through an inlet channel 108 into the working space 104, where it is compressed due to intermeshing of the male rotor 106 and the female rotor. Subsequently, the compressed air is discharged through an outlet channel 110 into an air-water separator tank 112, also referred to as the separator tank 112. The discharge may be regulated by a non-return valve 114. The separator tank 112 may separate the compressed air from water and supply the compressed air to a supply line (not shown in FIG. 1), where the compressed air is used.

Initially, the separator tank 112 is filled with water. This water is injected into the working space 104 to cool the working space 104, i.e., to remove the heat generated due to compression. For instance, the water enables cooling the male rotor 106 and the female rotor. Further, the water can seal clearances. The water may be supplied from the separator tank 112 to the working space 104 through a port 116 provided on the housing 102 via a pipe 118. The injection of water happens due to the pressure difference between the separator tank 112 and the point of injection in the working space 104.

The intrinsic moisture present in the air also condenses and adds to the water in the compressor 100. The condensation happens in two stages, of which some water gets condensed in the separator tank 112 and remaining water gets condensed in an air cooler or aftercooler (not shown in FIG. 1). The condensed water, which is free of any dissolved salts, is pure and helps to maintain the water quality and also compensates for any loss of water due to carry over in air. The level of water in the separator tank 112 is controlled using a level switch (not shown in FIG. 1), which drains any excess water.

Since water is a poor lubricant, the female rotor (not shown in FIG. 1) and the male rotor 106 are prevented from contacting each other and are synchronously rotated using a first gear (not shown in FIG. 1) and a second gear 120, respectively. The first gear may be coupled to the female screw rotor and referred to as a timing gear. The second gear 120 may be coupled to the male rotor 106 and may be referred to as a pinion gear 120 or a pinion 120. The timing gear and the pinion 120 synchronizes rotation of the female rotor and the male rotor 106 during their respective rotations and ensures that the clearance between the female rotor and the male rotor 106 is low enough for the efficient functioning of the compressor 100 and sufficient to avoid collision between the rotors.

The male rotor 106 and the female rotor are rotatably supported by bearings. For instance, the male rotor 106 and the female rotor may be mounted on their respective rotor shafts that are rotatably supported by bearings. The male rotor 106 is supported by a first bearing 122 and a second bearing 124 that are disposed in a first bearing chamber 126. Between the first bearing 122 and the second bearing 124 lies a region 125. The male rotor 106 may also be supported by a third bearing 128 in a second bearing chamber 130. Similarly, the female rotor may be supported by two bearings in the first bearing chamber 126 and one bearing in the second bearing chamber 130.

The first bearing chamber 126 may be a space defined by a first housing 132 and the second bearing chamber 130 may be a space defined by a second housing 134. The first bearing chamber 126 and the second bearing chamber 130 may be displaced from the working space 104 in an axial direction of the compressor 100. The first housing 132 may be referred to as the high-pressure housing 132 and the second housing 134 may be referred to as the low-pressure housing 134, the reason for which will be explained later.

The compressor 100 may include a first sealing system 136 and a second sealing system 138, each comprising a plurality of seals. The first sealing system 136 is disposed between the working space 104 and the first bearing 122 and the second sealing system 138 disposed between the working space 104 and the third bearing 128. The first sealing system 136 prevents flow of water from the working space 104 to the first bearing 122 and flow of oil from the first bearing chamber 126 to the working space 104. Similarly, the second sealing system 138 prevents flow of water from the working space 104 to the third bearing 128 and flow of oil from the second bearing chamber 130 to the working space 104. In an implementation, the first sealing system 136 may be housed in the high-pressure housing 132 and the second sealing system 138 may be housed in the low-pressure housing 134. The first sealing system 136 will be explained below:

The first sealing system 136 includes a plurality of seals displaced from each other in the axial direction of the compressor 100. For instance, between the working space 104 and the first bearing chamber 126, the first sealing system 136 includes seals arranged in the following order: a ring seal 140, which may be a floating carbon ring type seal, followed by a first labyrinth seal 142, followed by a second labyrinth seal 144, followed by a lip seal 146. The seals are mounted in this order in a direction from the working space 104 to the first and second bearings 122 and 124.

A first annular space 148 formed between the ring seal 140 and the first labyrinth seal 142 is connected to a point 150 on the working space 104 using an external pipe 152. A second annular space 154 formed between the first labyrinth seal 142 and the second labyrinth seal 144 is connected to a compressed air source, which may be the separator tank 112, through a flow regulator 156. A third annular space 158 formed between the second labyrinth seal 144 and the lip seal 146 is opened to outside of the compressor 100 by an opening 159.

Similarly, on the low-pressure housing 134, adjacent to the working space 104 is a ring seal 160, such as a floating carbon ring seal, followed by two labyrinth seals 162 and 164. Adjacent to the labyrinth seal 164, a lip seal 166 similar to the lip seal 146 is disposed. Accordingly, in the direction from the working space 104 towards the third bearing 128, the seals are arranged in the following order: the ring seal 160, the labyrinth seal 162, the labyrinth seal 164, and the lip seal 166. An annular space 168 between the ring seal 160 and labyrinth seal 162 is connected to a compressed air source through the flow regulator 156. The annular spaces between the two labyrinth seals 162 and 164 and between the labyrinth seal 164 and lip seal 166 is opened to outside of the compressor 100 through openings 170 and 172.

The sealing system according to the subject matter functions in the following way.

During operation of the compressor 100, a suction is provided at a region of the working space 104 below the inlet channel 108 to draw air inside the working space 104. The drawn air is compressed by the intermeshing of the male rotor 106 and the female rotor. Accordingly, as the air gets compressed and moves in the working space 104 in a right-hand side direction, the pressure of the air increases. The compressed air may then be discharged through the outlet channel 110. Thus, a pressure gradient exists in the working space 104, where the pressure increases in the right-hand side direction. The high-pressure housing 132 and the low-pressure housing 134 are called so due to their respective proximities with the regions of the working space 104 having a high pressure and a low pressure, respectively.

At normal full load capacity of the compressor 100, the pressure in a region of the working space 104 adjacent to the high-pressure housing 132 is high. Accordingly, a mixture of air and water at high pressure tends to leak across the male rotor 106 to the first bearing chamber 126. The ring seal 140, owing to its very low clearance, which may be to the extent of 0.10 mm, between the shafts helps reducing the leakage significantly. Whatever air-water mixture leaks past the ring seal 140 is directed through the first annular space 148 into the point 150 in the working space 104. The point 150 may be provided below the inlet channel 108.

A position of the point 150 may be selected such that the pressure at this point is slightly lesser than that at the high-pressure housing 132 during operation of the compressor 100. Accordingly, the point 150 may be referred to as the low-pressure point 150. Therefore, the air-water mixture may enter the low-pressure point by virtue of the pressure difference. Further, the compressor 100 may be disposed such that the low-pressure point 150 at a lower height from the ground as compared to the first annular space 148. This will aid the flow of the air-water mixture from the first annular space 148 into the low-pressure point 150 by gravity. The low-pressure point 150 may be provided in the form a port drilled in the wall of the housing 102.

The first and the second labyrinth seals 142 and 144 prevent any air and/or water which has leaked past the ring seal 140 from entering the lubricant near the first and second bearings 122 and 124. The first and the second labyrinth seals 142 and 144 are supported by supply of pressurized air from the separator tank 112 through the flow regulator 156 to the second annular space 154. The pressure in the second annular space 154 is maintained using the flow regulator 156 in a range of 0.1 to 0.3 bar above the atmospheric pressure. The high-pressure in the second annular space 154 thus helps to block the leakage flow across the second labyrinth seal 144 and also aids to push the leaked air and/or water present in the second annular space 154 into the low-pressure point 150 through the pipe 152.

A part of the pressurized air and/or water in the second annular space 154 may also escape through the second labyrinth seal 144 into the third annular space 158, from where it is vented out through the opening 159. Hence, entry of water into the first bearing chamber 126 can be prevented. Since the first bearing chamber 126 houses the bearings 122 and 124, the timing gear, and the pinion 120, which are lubricated by a lubricant, the mixing of water and the lubricant is prevented by the arrangement of the first sealing system 136 and the annular spaces as explained above. The lubricant may be, for example, oil. Accordingly, the words lubricant and oil may be used interchangeably in the below description.

Adjacent to the third annular space 158 is the lip seal 146 which may include three lips that are spaced apart from each other in the axial direction of the compressor 100. Of the three lips, a first lip may be closer to the working space 104 than a second lip and a third lip. Further, the third lip is closer to the bearings 122 and 124 than the first and second lips. The first and second lips may help in sealing water, while the third lip may help in sealing oil.

During the normal operating conditions, the first and second lips do not come into action, as no water reaches these lips. Even during unload condition of the compressor 100, i.e., less than full-load condition, though the pressure in a region of the working space 104 adjacent to the high-pressure housing 132 is reduced, it is still maintained above atmospheric pressure due to the operation of the compressor 100. Owing to this, the leakage rate of air and/or water towards the bearings 122 and 124 is reduced. The first sealing system 136 works in the similar manner as described above for full load condition and thereby prevents entry of air and/or water into the lubricated areas.

However, during situations like emergency shutdown or power failure when operating at discharge pressures in excess of 10 bar(g), water may flood into the first sealing system 136. During such conditions, the first and second sealing lips help in preventing water drops from passing to the bearings 122 and 124. The sealing arrangement thus described above helps to seal the water air mixture from travelling along the shaft towards the bearings 122 and 124.

To prevent any lubricant used for bearing lubrication from flowing to the working space 104, the third lip is used. To reduce the load of lubricant on the third lip, the present subject matter utilizes a splash lubrication technique for lubricating the bearings and the gears. Such a lubrication method ensures that only a minimal amount of lubricant that is sufficient for bearing lubrication is applied onto the bearings 122 and 124. The splash lubrication technique will be explained with reference to FIG. 2.

The second sealing system 138 may function in a manner similar to the first sealing system 136. For instance, during emergency shutdown or power failure, water may flood into annular spaces between the seals of the second sealing system 138 also. In such cases, the ring seal 160 ensures that only a minimal water quantity will leak past it. Further, the pressurized air supplied into the annular space 168 from the separator tank 112 stops the water from travelling across the labyrinth seal 162. Any water traces which leaks through the first labyrinth seal 162 into the third annular space 174 is vented out through the opening 172. The second labyrinth seal 164, the opening 170 of the annular space 176, and the two water-sealing lips of the lip seal 166 provide additional support and prevent entry of water into the lubricated areas of the low-pressure housing 134.

Figure 2:
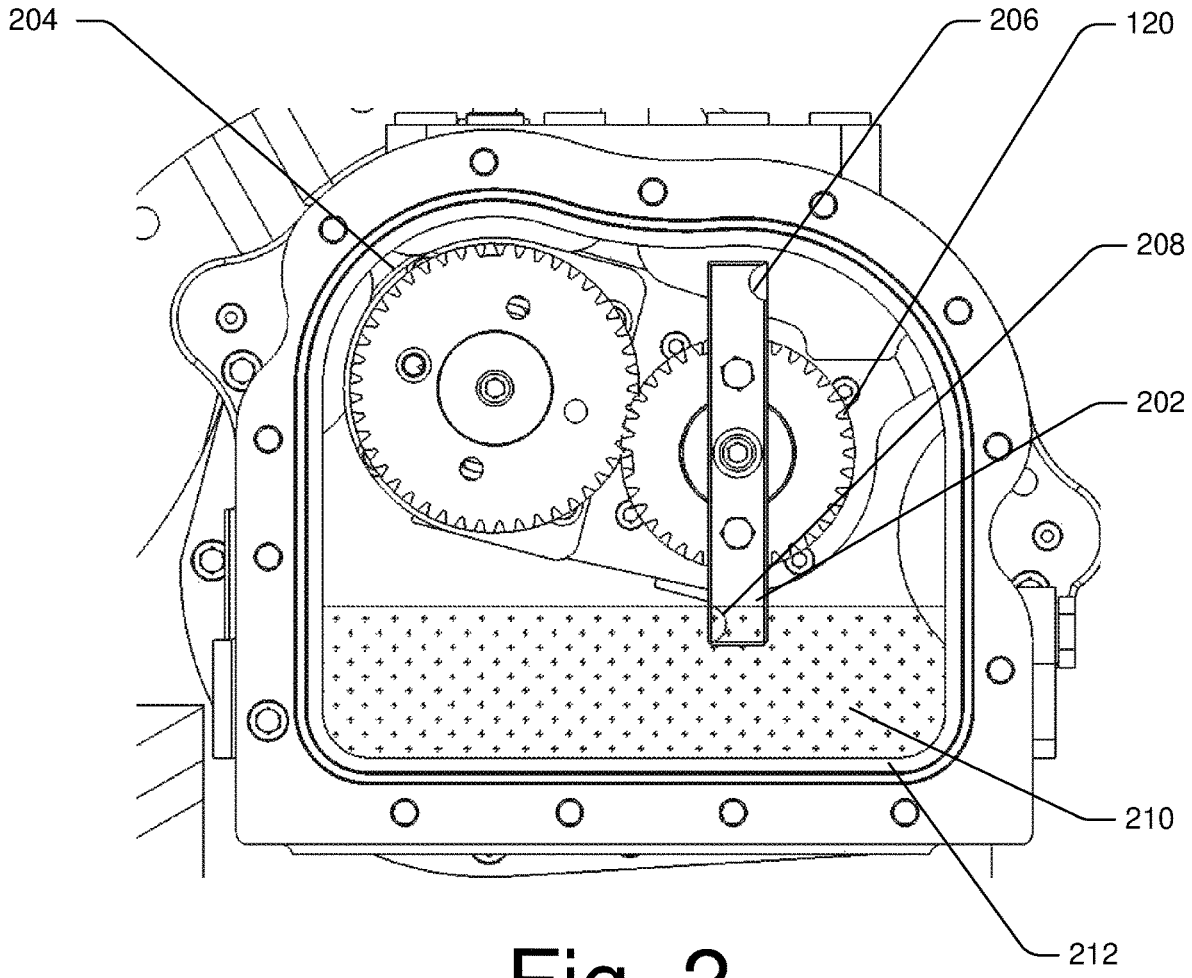
FIG. 2 shows details of a splash lubrication arrangement of a screw compression device, in accordance with an example implementation of the present subject matter.

FIG. 2 illustrates a splash lubrication arrangement of the screw compression device 100, in accordance with an example implementation of the present subject matter. The first bearing chamber 126 may include a lubricant splasher 202, which may be coupled to the timing pinion 120 and hence rotates along with it. In another example, the lubricant splasher 202 may be coupled to the timing gear 204. The lubricant splasher 202 may be interchangeably referred to as the oil splasher 202.

The lubricant splasher 202 may be bar-shaped. A groove 206 is provided at an end of the oil splasher 202. In addition, another groove 208 may be provided at an opposite end of the oil splasher 202. As the oil splasher 202 rotates, the grooves 206 and 208 collect oil 210 from an oil sump 212 and splash the oil onto the bearings 122 and 124, timing gear 204, and the timing pinion 120. It will be understood that the grooves can be designed to supply a requisite quantity of oil required for lubrication of bearings 122 and 124 and timing gear 204 and pinion 120 during rotation.

The grooves of the oil splasher 202 is sized such that only minimal quantity of oil to lubricate and maintain the bearing temperature is collected for splashing. Thus, the splash lubrication technique according to the present subject matter ensures that the bearings 122 and 124 are lubricated without increasing load on the third lip of the lip seal 146. Compared to a pressurized lubrication system, the splash lubrication technique offers the same quality of lubrication, but with reduced load on the third lip, thereby ensuring its prolonged operating life. In addition to this, even in case of lip seal failure, the splash lubrication ensures that only minimal oil quantity will leak past the lip seal 146 and the same will be drained out through the third annular space 158 and the opening 159, thus giving sufficient warning to the operator to replace the lip seal 146.

Similar to the first bearing chamber 126, the second bearing chamber 130 also utilizes the splash lubrication technique. However, in the low-pressure housing 134, instead of an oil splasher, a gear (not shown in FIG. 2) may be used for splashing oil from oil sump. The gear may be a speed-increasing gear or a speed-decreasing gear.

Figure 3:
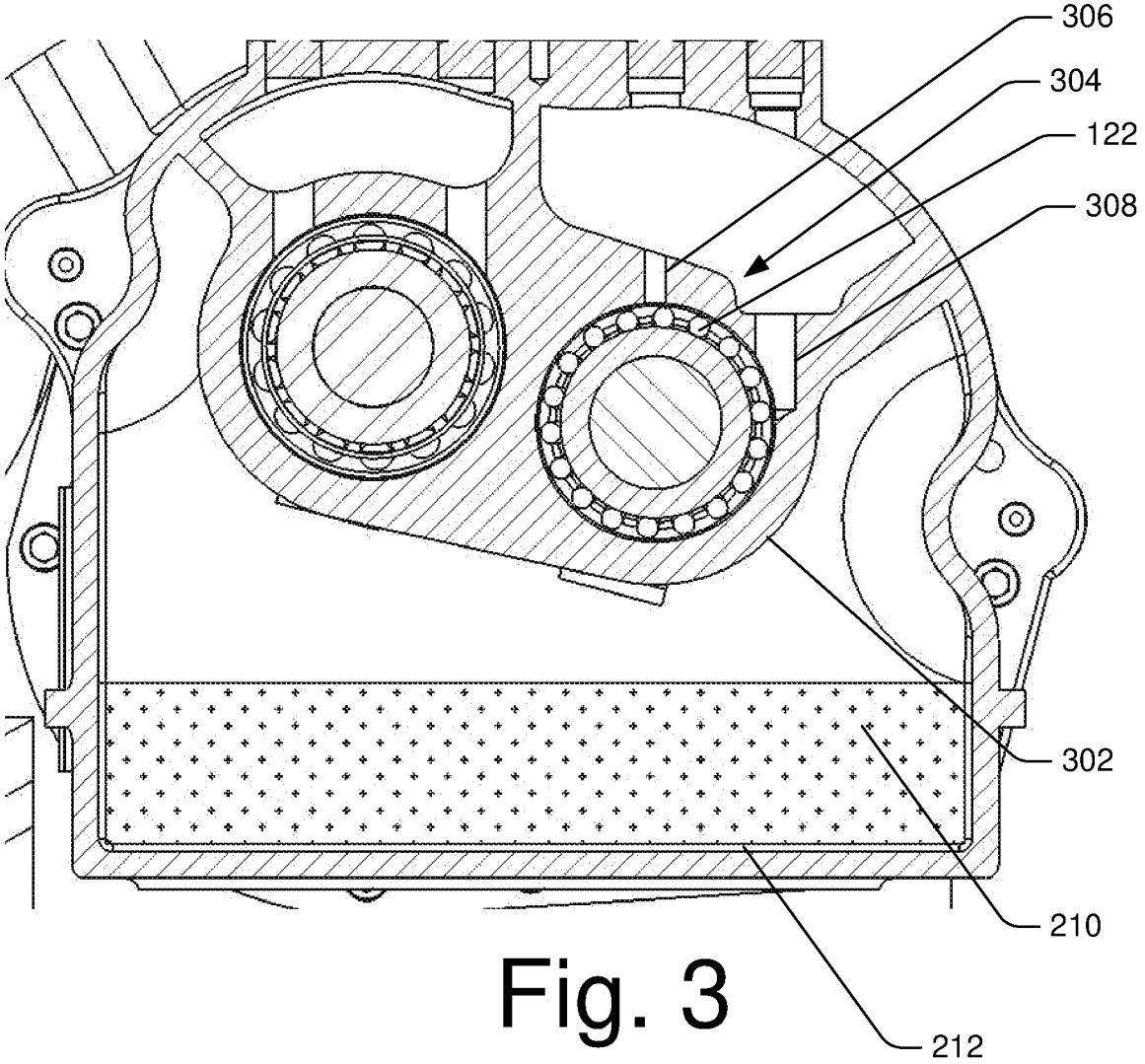
FIG. 3 shows of collection and routing of lubricant in a splash lubrication arrangement, in accordance with an example implementation of the present subject matter.

FIG. 3 illustrates collection and routing of lubricant in a splash lubrication arrangement, in accordance with an example implementation of the present subject matter. As illustrated, the first bearing chamber 126 includes a bearing core 302 having cavities drilled therein, in which the first bearing 122 and the second bearing 124 are disposed. The bearing core 302 includes receptacles 306 and 308 to collect lubricant that splashed on the bearings 122 and 124. Further, an outer surface 304 of the bearing core 302 is inclined towards the receptacles 306 and 308. This allows splashed oil to get collected in the receptacles 306 and 308 due to gravity.

As explained earlier, the bearings 122 and 124 are splash lubricated using the oil splasher 202, which may be bolted on to the pinion 120. An end of the oil splasher 202 may be provided with a machined groove 206 which is used to scoop oil 210 out of the oil sump 212. The oil thrown onto the walls of the high-pressure housing 132 are routed into the region 125 (not shown in FIG. 3) between the bearings 122 and 124 for lubrication. For example, as discussed above, the oil is routed via the receptacles 306 and 308.

Another embodiment of the present subject matter is to maintain lubrication of the bearings during start-up of the compressor 100. In a pressurized lubrication system, an oil pump is normally switched on prior to the rotation of the rotor shaft to ensure that the bearings do not start dry. However, as the oil pump is absent in the present subject matter, the bearings 122, 124, and 128 will normally tend to start dry, which may reduce their life. To eliminate this drawback, the compressor 100 is provided with a bearing retainer plate, also referred to as a retainer plate, that will always maintain a minimum quantity of oil in the bearings.

Figure 4:
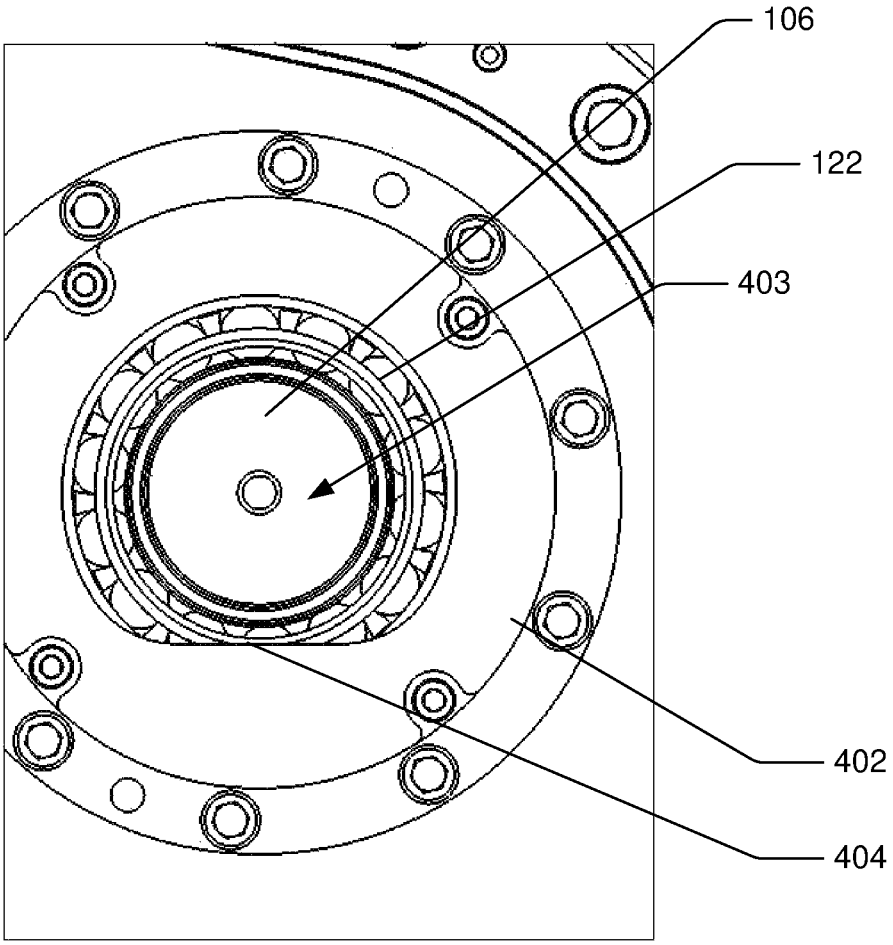
FIG. 4 shows an arrangement in a screw compression device to ensure bearing lubrication during start up, in accordance with an example implementation of the present subject matter.

FIG. 4 illustrates a retainer plate 402 coupled the first bearing 122, in accordance with an example implementation of the present subject matter. The retainer plate 402 may serve to retain the first bearing 122 in the first bearing chamber 126 during rotation of the first bearing 122. The retainer plate 402 may be annular and have an opening 403 around its centre. The opening 403 may be sized according to the size of the first bearing 122. For instance, the first bearing 122 may be exposed outside through the opening 403, as illustrated.

The retainer plate 402 is provided with a projection 404 at its bottom that projects towards the opening 403. The projection 404 may cover (wholly or partially) at least one roller of the first bearing 122. The projection 400 may retain some oil during splash lubrication, even when the compressor 100 is not running. The projection 404 comes in contact with bearing rollers at the bottom of the bearing 122 during rotation of the first bearing 122. Accordingly, during starting of the compressor 100, the bearing rollers at the bottom of the first bearing 122 come in contact with the oil trapped in a space between the projection 404 and the first bearing 122. This ensures that rollers of the first bearing 122 are lubricated during the starting as they come in contact with the trapped oil. Similar projections may be provided on the retainer plates of other bearings as well.

Another embodiment of the present subject matter is to maintain the temperature of oil in the oil sump 212. The splashed oil, after lubrication of the bearings, is drained into the oil sump 212. This oil is at a higher temperature and therefore, over a period of time, this oil will mix with the oil in the oil sump 212, increasing its temperature. The mechanical action of the oil splasher 202 in the oil sump 212 will also add to increase in the oil temperature. As there is no pump for oil circulation, in the present subject matter, the oil temperature is maintained using water circulation. For this, the water before injection into the working space 104 is passed through the oil sump 212, as will be explained below.

Figure 5:
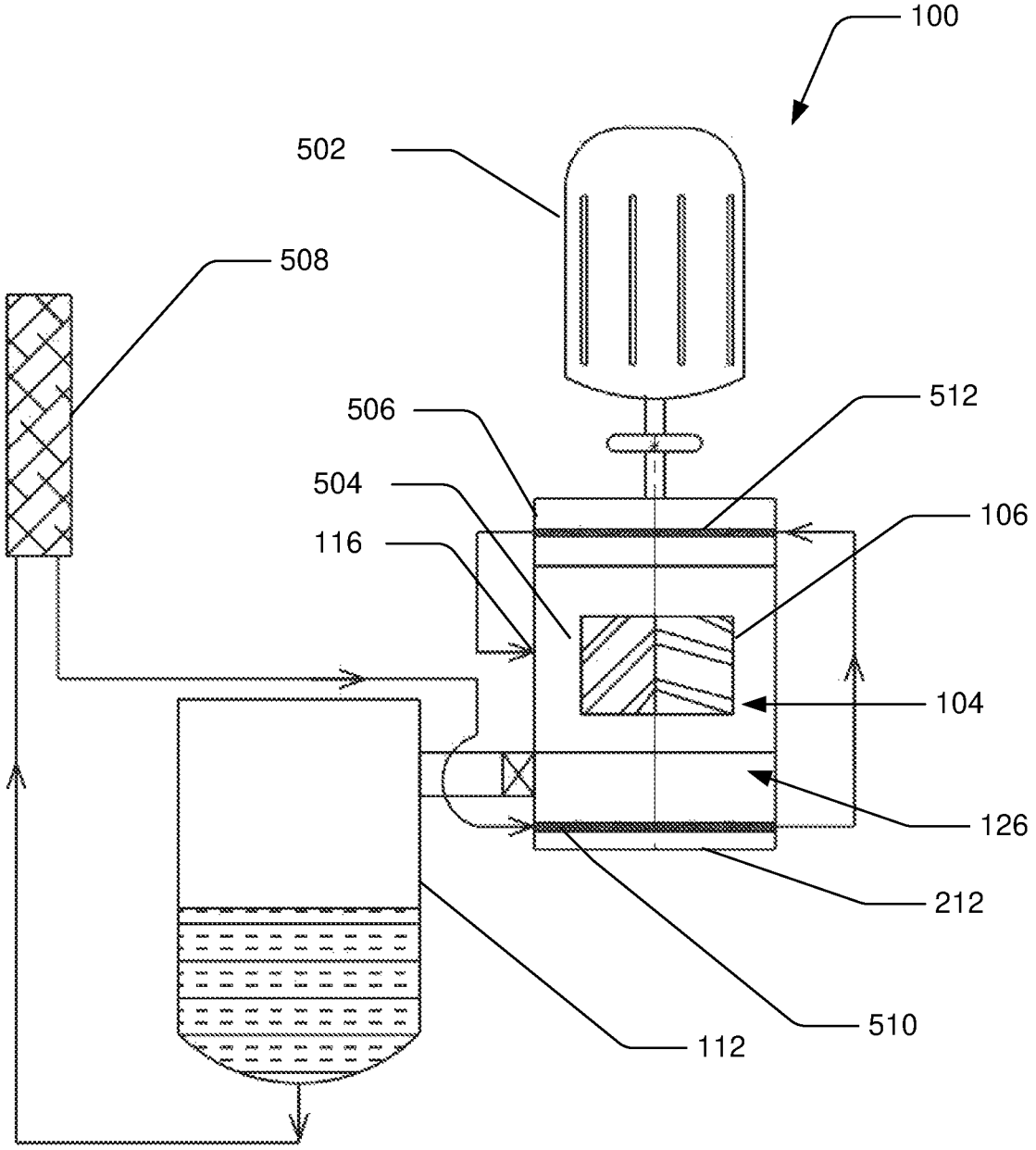
FIG. 5 shows the layout of the cooling arrangement for oil sump of a screw compression device, in accordance with an example implementation of the present subject matter.

FIG. 5 illustrates a circuit for cooling the oil in oil sumps of the compressor 100, in accordance with an example implementation of the present subject matter. The compressor 100 includes a motor 502 which drives at least one of the screw rotors, such as the male rotor 106 and the female rotor 504. In an example, to drive a screw rotor, a third gear enclosed in a casing 506 may be utilized. The third gear may be a speed-increasing gear or a speed-decreasing gear. The motor 502 may be coupled to the screw rotor through the third gear. In another example, the motor 502 may be coupled directly to a shaft of the screw rotor, i.e., without using the third gear.

The bottom of the casing 506 acts as an oil sump. Similarly, there is the oil sump 212 that encloses the timing gear and the pinion 120. The water from the separator tank 112 is passed through a water cooler 508, to which the separator tank 112 is coupled. The water cooler 508 is also coupled to the first bearing chamber 126. For instance, the cooled water from the water cooler 508 is connected to a first conduit pipe 510 in the first bearing chamber 126. The first conduit pipe 510 passes through the oil sump 212, causing cooling of the oil in the oil sump 212. The water, after passing through the oil sump 212, passes through a second conduit pipe 512 in the oil sump in the casing 506. This water is then injected into the working space 104 through the port 116.

Another embodiment of the present subject matter is to provide a rotating radial member in the space between the second labyrinth seal 144 and the lip seal 146. This rotating radial member, called thrower, will prevent any oil or water from travelling axially along the rotor shaft. Even if the third lip of the lip seal fails, the thrower will prevent any migration of oil towards the working space 104.

FIG. 6. illustrates the rotating radial member 602 provided on rotor shaft between the second labyrinth seal 144 and the lip seal 146 to prevent migration of the oil towards the working space 104, in accordance with an example implementation of the present subject matter. Similarly, another rotating radial member may be provided between the second labyrinth seal 164 and the lip seal 166 on the low-pressure housing 134.

Figure 6A:
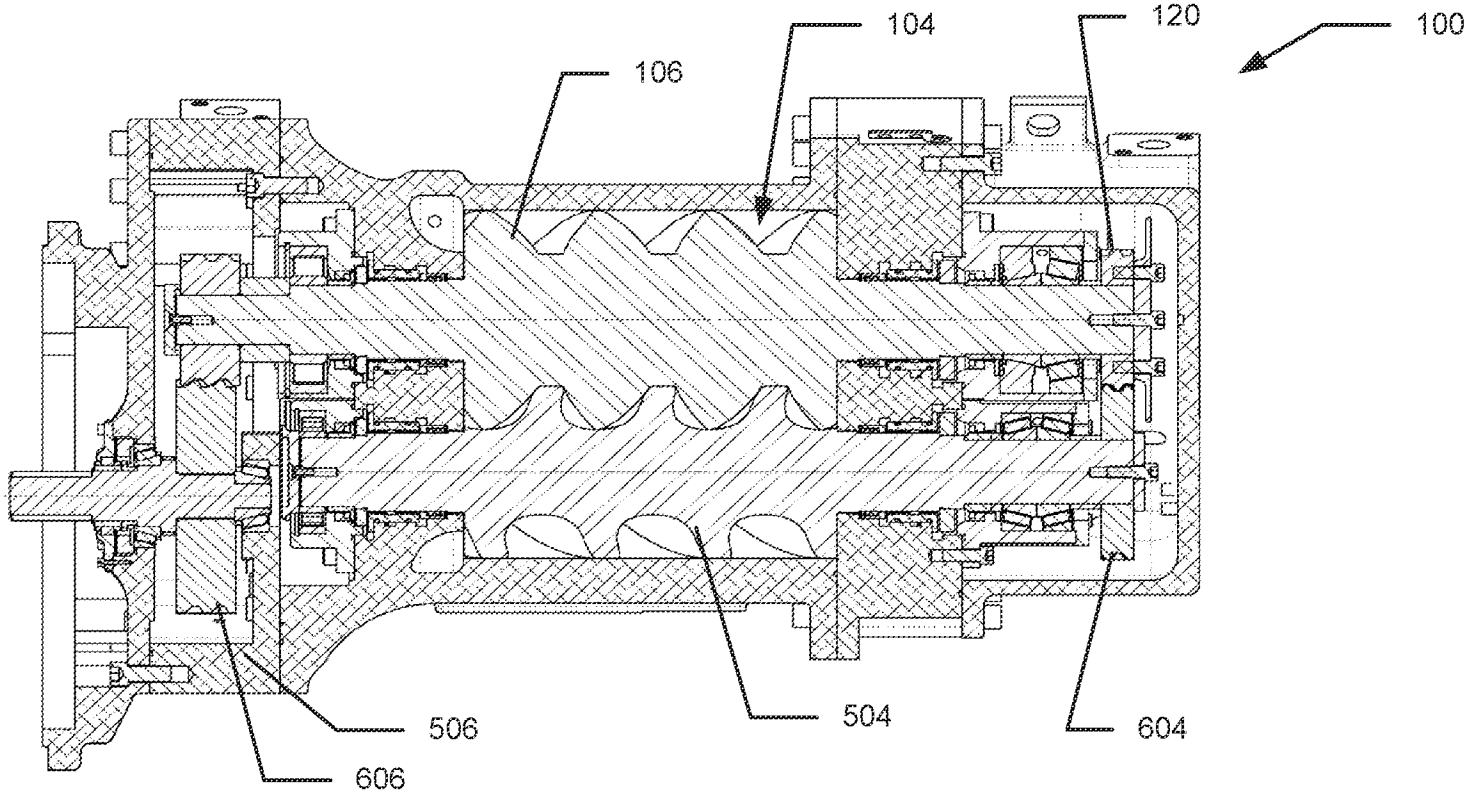
FIG. 6A illustrates a horizontal section of a screw compression device, in accordance with an example implementation of the present subject matter.

FIG. 6A illustrates a horizontal section of a screw compression device, in accordance with an example implementation of the present subject matter. The working space 104 encloses the male rotor 106 and the female rotor 504. The female rotor 504 and the male rotor 106 are synchronously rotated using the first gear 604 and a second gear 120, respectively. The compressor 100 includes the motor 502 (not shown in FIG. 6A) which drives at least one of the screw rotors, such as the male rotor 106 and the female rotor 504. In an example, to drive a screw rotor, a third gear 606 enclosed in the casing 506 may be utilized. The third gear 606 may be a speed-increasing gear or a speed-decreasing gear. The motor 502 may be coupled to the female rotor 504 through the third gear 606. In another example, the motor may be coupled directly to a shaft of the female rotor 504, i.e., without using the third gear 606.

Figure 6B:
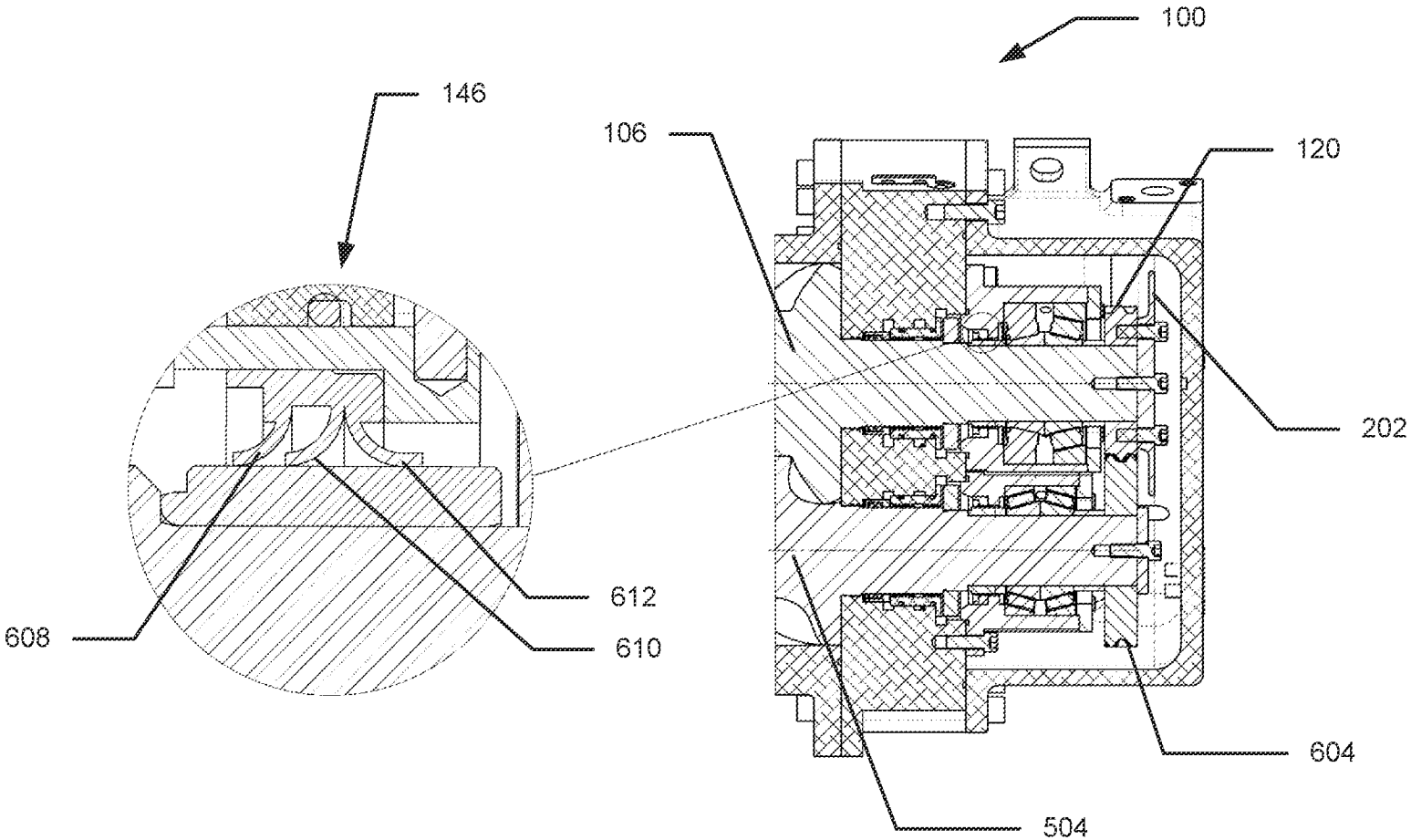
FIG. 6B illustrates a portion of the horizontal section of a screw compression device and enlarged view of lip seal, in accordance with an example implementation of the present subject matter.

FIG. 6B illustrates a portion of the horizontal section of a screw compression device and enlarged views of lip seal, in accordance with an example implementation of the present subject matter. The lip seal 146 may include three lips that are spaced apart from each other in the axial direction of the compressor 100. Of the three lips, a first lip 608 may be closer to the working space 104 than a second lip 610 and a third lip 612.

Figure 7:
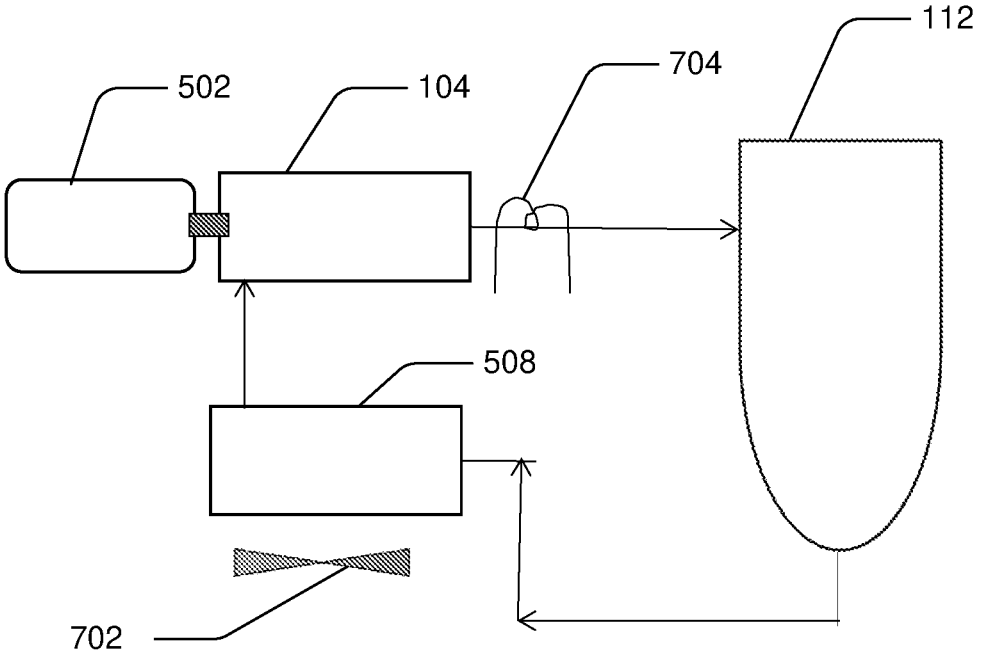
FIG. 7 illustrates a schematic arrangement to prevent the growth of microbes in a compressor, in accordance with an example implementation of the present subject matter.

In some cases, the presence of water inside the compressor 100 may lead to growth of microbes, especially when the compressor 100 is not operational. Hence, an embodiment of the present subject matter enables prevention of growth of microbes in the compressor 100, as will be explained below:

FIG. 7 illustrates a schematic arrangement to prevent the growth of microbes in the compressor 100, in accordance with an example implementation of the present subject matter. Generally, microbes that tend to grow in water cannot survive at temperatures in the excess of 40° C. Accordingly, in an embodiment, excessive temperature conditions are created inside the compressor 100 by controlling a fan 702 that is utilized to cool the water in the water cooler 508. Accordingly, by switching off the fan 702, water is supplied to the working space 104 without cooling. This causes an elevation in the temperature inside the working space 104. Once the temperature reaches a threshold temperature, the fan 702 may be switched on. The threshold temperature may be, for example, 75° C. to sense the temperature of the working space 104, a temperature sensor 704 may be utilized. The temperature sensor 704 may sense the temperature of air and/or water discharged from the working space 104 to the separator tank 112. The increase in the temperature to the threshold temperature inhibits microbial growth in the compressor 100

Figure 8:
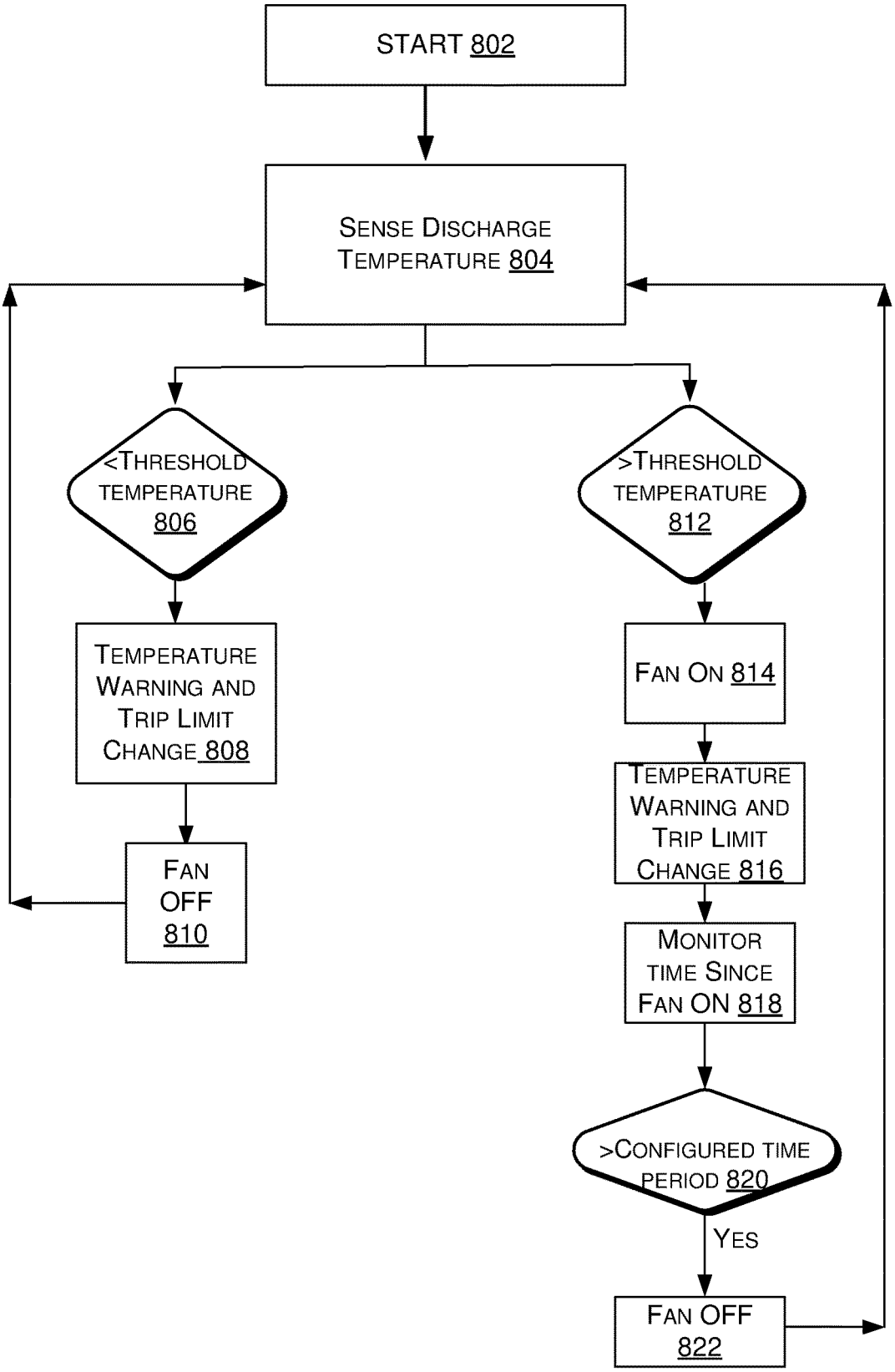
FIG. 8 illustrates a method performed to inhibit the growth of microbes in a compressor, in accordance with an example implementation of the present subject matter.

FIG. 8 illustrates a method 800 performed to inhibit the growth of microbes in the compressor 100, in accordance with an example implementation of the present subject matter. The method 800 may be performed by a controller, which may be a programmed logic control system, of the compressor 100.

Upon starting (step 802) the compressor 100, the discharge temperature from the working space 104 is sensed (step 804). If the temperature is lesser than the threshold temperature (step 806), a temperature warning limit and trip limit are changed (step 808), and the fan 702 is switched off (step 810). The temperature warning limit and trip limit are changed to ensure that warning and tripping does not happen due to an increase in the temperature during this process. Subsequently, the discharge temperature is sensed (step 804), and once the discharge temperature is greater than the threshold temperature (step 812), the fan 702 is switched on (step 814). At this stage, the change made to the temperature warning limit and trip limit at step 808 are undone (step 816) to ensure alarms and trips during normal operation of the compressor 100.

Subsequently, a time period since the turn on of the fan 702 is monitored (step 818). Once a configured time period after the turn on of the fan 702 elapses (step 820), the fan 702 is switched off (step 822). Subsequently, the discharge temperature is sensed (step 804) and once the threshold temperature is breached (step 812), the fan 702 is switched on again (step 814). As will be understood, the switching off of the fan 702 is performed periodically. The configured time period may be, for example, 8 hours.

Accordingly, a screw compression device of the present subject matter includes a housing defining a working space in which air is to be compressed, a male screw rotor disposed in the working space, and a female screw rotor disposed in the working space. An intermeshing of the male screw rotor and the female screw rotor causes compression of air. A separator tank separates air and water in an air-water mixture and supplies water to the working space for cooling the working space. A first bearing chamber displaced from the working space in an axial direction of the screw compression device comprises a first bearing to support at least one of: the male screw rotor and the female screw rotor and a lubricant sump to store lubricant for lubrication of the first bearing. A sealing system comprising a plurality of seals is arranged between the working space and the first bearing in the following order: a ring seal, a first labyrinth seal, a second labyrinth seal, and a lip seal. A first annular space is formed between the ring seal and the first labyrinth seal, a second annular space is formed between the first labyrinth seal and the second labyrinth seal, and a third annular space is formed between the second labyrinth seal and the lip seal. The first annular space is connected to a low-pressure point on the working space that is to be maintained at a pressure lower than that of the first bearing chamber. The second annular space is supplied with compressed air from a compressed-air source through a flow regulator. The third annular space is open to outside of the screw compression device.

Although the present subject matter has been described with reference to specific example embodiments, this description is not meant to be construed in a limiting sense. Various modifications of the disclosed embodiments, as well as alternate embodiments of the subject matter, will become apparent to persons skilled in the art upon reference to the description of the subject matter and are intended to be covered herein.

We claim:

1. A screw compression device comprising:

a housing defining a working space in which air is to be compressed;

a male screw rotor disposed in the working space;

a female screw rotor disposed in the working space, wherein an intermeshing of the male screw rotor and the female screw rotor causes compression of air;

a separator tank to separate air and water in an air-water mixture and to supply water to the working space for cooling the working space;

a first bearing chamber displaced from the working space in an axial direction of the screw compression device and comprising:

a first bearing to support at least one of: the male screw rotor and the female screw rotor;

a lubricant sump to store lubricant for lubrication of the first bearing;

a first gear coupled to one of: the female screw rotor and the male screw rotor; and a lubricant splasher coupled to the first gear, wherein the lubricant splasher comprises a groove to collect lubricant from the lubricant sump and splash the collected lubricant on the first bearing during rotation of the first gear;

a first sealing system comprising a plurality of seals arranged between the working space and the first bearing in the following order:

a ring seal;

a first labyrinth seal;

a second labyrinth seal, and a lip seal, wherein a first annular space is formed between the ring seal and the first labyrinth seal, a second annular space is formed between the first labyrinth seal and the second labyrinth seal, and a third annular space is formed between the second labyrinth seal and the lip seal, wherein the first annular space is connected to a low-pressure point on the working space that is to be maintained at a pressure lower than that of the first bearing chamber, the second annular space is supplied with compressed air from a compressed-air source through a flow regulator, and the third annular space is open to outside of the screw compression device.

2. The screw compression device as claimed in claim 1, wherein the first bearing chamber comprises:

a second gear coupled to one of: the male screw rotor and the female screw rotor, wherein the first gear and the second gear synchronise rotation of the female screw rotor and the male screw rotor.

3. The screw compression device as claimed in claim 2, wherein the first bearing chamber comprises a bearing core having a cavity drilled therein in which the first bearing is disposed, wherein the bearing core comprises:

a receptacle to collect the lubricant that splashed on the first bearing, wherein the bearing core comprises an outer surface that is inclined towards the receptacle.

4. The screw compression device as claimed in claim 2, comprising:

a retainer plate coupled to the first bearing to retain the first bearing in the first bearing chamber during rotation of the first bearing, the retainer plate being annular and having an opening around its centre having a size corresponding to a size of the first bearing, wherein the retainer plate comprises:

a projection at its bottom, the projection projecting towards the opening to cover at least one roller of the first bearing.

5. The screw compression device as claimed in claim 1, wherein the lip seal comprises:

a first lip, a second lip, and a third lip, wherein the first lip is closer to the working space as compared to the second lip and the third lip and wherein the third lip is closer to the first bearing as compared to the first lip and the second lip.

6. The screw compression device as claimed in claim 1, wherein the ring seal is a floating carbon ring seal.

7. The screw compression device as claimed in claim 1, comprising:

a rotating radial member disposed between the second labyrinth seal and the lip seal to prevent migration of the oil to the working space.

8. The screw compression device as claimed in claim 1, wherein the first bearing chamber comprises:

a second bearing to support the at least one of: male screw rotor and the female screw rotor.

9. The screw compression device as claimed in claim 1, comprising:

a second bearing chamber displaced from the housing in the axial direction of the screw compression device, the second bearing chamber comprising:

a third bearing to support at least one of: the male screw rotor and the female screw rotor.

10. The screw compression device as claimed in claim 9, comprising:

a second sealing system comprising a second plurality of seals arranged between the working space and the third bearing in the following order:

a second ring seal;

a third labyrinth seal;

a fourth labyrinth seal, and a second lip seal, wherein a fourth annular space is formed between the second ring seal and the third labyrinth seal, a fifth annular space is formed between the third labyrinth seal and the fourth labyrinth seal, and a sixth annular space is formed between the fourth labyrinth seal and the second lip seal, wherein the fourth annular space is supplied with compressed air from the compressed-air source through the flow regulator, and the fifth annular space and the sixth annular space are open to outside of the screw compression device.

11. The screw compression device as claimed in claim 1, comprising:

an inlet channel to supply air to the working space for being compressed; and an outlet channel to discharge compressed air from the working space to the separator tank.

12. The screw compression device as claimed in claim 1, comprising:

a water cooler coupled to the separator tank and to the first bearing chamber to:

receive water from the separator tank to cool the water; and supply cooled water to the first bearing chamber through a first conduit pipe; and the first conduit pipe passing through the lubricant sump to receive the cooled water to cool the lubricant in the lubricant sump.

13. The screw compression device as claimed in claim 12, comprising:

a motor to rotate at least one of: the male screw rotor and the female screw rotor;

a gear casing;

a third gear disposed in the gear casing and coupled to the motor and to the one of: the male screw rotor and the female screw rotor;

a second lubricant sump to store lubricant to lubricate the third gear; and a second conduit pipe passing through the second lubricant sump and coupled to the first conduit pipe and to the working space to receive water from the second conduit pipe and supply water to the working space.

14. The screw compression device as claimed in claim 12, comprising:

a fan to cool water in the water cooler;

a temperature sensor to sense temperature of at least one of: air and water discharged from the working space to the separator tank; and a controller to:

turn off the fan periodically to cause an increase in temperature of water in the separator tank; and turn on the fan in response to the sensed temperature increasing beyond a threshold temperature.

15. The screw compression device as claimed in claim 1, wherein the low-pressure point is disposed at a lower height from a ground as compared to the first annular space.

16. The screw compression device as claimed in claim 1, wherein the compressed air source is the separator tank.

* * * * *